US006154923A

United States Patent [19]

Carpinella

[11] Patent Number: 6,154,923

[45] Date of Patent: Dec. 5, 2000

[54] HIGH HOLD FURNITURE GLIDE

[75] Inventor: Ralph Carpinella, Middlebury, Conn.

[73] Assignee: Carpin Manufacturing, Inc., Waterbury, Conn.

[21] Appl. No.: 09/280,362

[22] Filed: Mar. 29, 1999

[51] Int. Cl.[7] ..... A47B 91/06

[52] U.S. Cl. ..... 16/42 R; 248/188.9

[58] Field of Search ..... 16/42 T, 42 R, 16/30; 248/188.9

[56] References Cited

U.S. PATENT DOCUMENTS

| | | | |
|---|---|---|---|
| 934,005 | 9/1909 | Neuberth | 16/30 |
| 2,753,586 | 7/1956 | Metz | 16/42 R |
| 2,755,114 | 7/1956 | Becker | 16/42 R |
| 2,860,368 | 11/1958 | Thornsbury | 16/42 R |
| 3,076,221 | 2/1963 | Reynolds | 16/42 R |
| 3,363,280 | 1/1968 | Vasseur | 16/42 R |
| 3,505,724 | 4/1970 | Leitner et al. | 16/42 R |
| 5,991,974 | 11/1999 | Carpinella | 16/42 R |

*Primary Examiner*—Chuck Y. Mah
*Attorney, Agent, or Firm*—Alix, Yale & Ristas, LLP

[57] ABSTRACT

A furniture glide includes a ferrule having an upstanding cylindrical side wall defining a ferrule opening for receiving a furniture leg. Four substantially equidistantly spaced, upstanding ribs extend laterally inward from the side wall to a guide surface. The diameter of the circle formed by the four guide surfaces is substantially the same as that of the ferrule opening. A clip mounted in the ferrule has a pair of upstanding opposed clip arms. A plurality of prongs extend radially inward from each clip arm such that the distance between the prongs of the first and second clip arms is less than the diameter of the ferrule opening. A glide base on the furniture glide contacts the floor.

19 Claims, 5 Drawing Sheets

HIGH HOLD FURNITURE GLIDE

FIELD OF THE INVENTION

This invention relates to the field of furniture glide components. More specifically, this invention relates to an improved swiveling furniture glide for the leg of an article of furniture and a method for manufacture of the same.

BACKGROUND OF THE INVENTION

Furniture glides are well known for fixation to the leg of an article of furniture to protect the end portion of the leg from damage, and further, to protect a floor surface from damage as a result of the furniture leg.

The conventional furniture glide typically employs a plastic bottom surface for contact with the floor to allow sliding of the furniture on a floor surface without excessive gouging or scratching of that floor surface. Furthermore, the conventional furniture glide spreads the mass of the furniture and any additional mass, for example, a person sitting in a chair, over a larger surface area to prevent denting or impression into the floor surface. Some furniture glides further employ a swiveling mechanism to allow the bottom of the glide to rest flat on a floor surface for varying angles of the furniture leg. The swiveling mechanism compensates for slight variations in the lengths of the legs of furniture, variations in the flatness of the floor surface, and splay in the legs of the article of furniture.

SUMMARY OF THE INVENTION

Briefly stated, the invention in one preferred form is a furniture glide which includes a ferrule having an upstanding cylindrical side wall. Four substantially equidistantly spaced, upstanding ribs extend laterally inward from the side wall to a guide surface. The diameter of the circle formed by the four guide surfaces is substantially the same as that of the ferrule opening for receiving the furniture leg. A clip positioned in the ferrule has a pair of upstanding opposed clip arms. A plurality of prongs extend radially inward from each clip arm such that the distance between the prongs of the first and second clip arms is less than the diameter of the ferrule opening. A glide base on the furniture glide contacts the floor.

The space between the four ribs define two pair of oppositely disposed channels, where the clip arms are disposed in one of the pairs of channels. In a preferred embodiment, each rib extends from the bottom wall of the ferrule to a point adjacent the ferrule opening to provide continuous guidance to the furniture leg as it is inserted into the ferrule.

Each clip arm has multiple prongs to ensure maximum engagement between the clip and the furniture leg. Preferably, first and second prongs are spaced equidistantly from the clip centerline and a third prong is positioned on the clip centerline. The third prong is longitudinally spaced above or below the first and second prongs to ensure that each prong engages the furniture leg independently of the other prongs. In an alternate, clip-free, embodiment, at least one prong extends radially inward from each rib such that the diameter of the circle formed by the prongs is less than the diameter of the ferrule opening.

An object of the invention is to provide a furniture glide having an improved clip for engagement to a furniture leg.

Another object of the invention is to provide a furniture glide having an improved ferrule for facilitating installation of the glide on a furniture leg.

These and other objects of the invention are readily apparent from review of the specification and drawings.

DETAILED DESCRIPTION OF THE INVENTION

Figure 1:
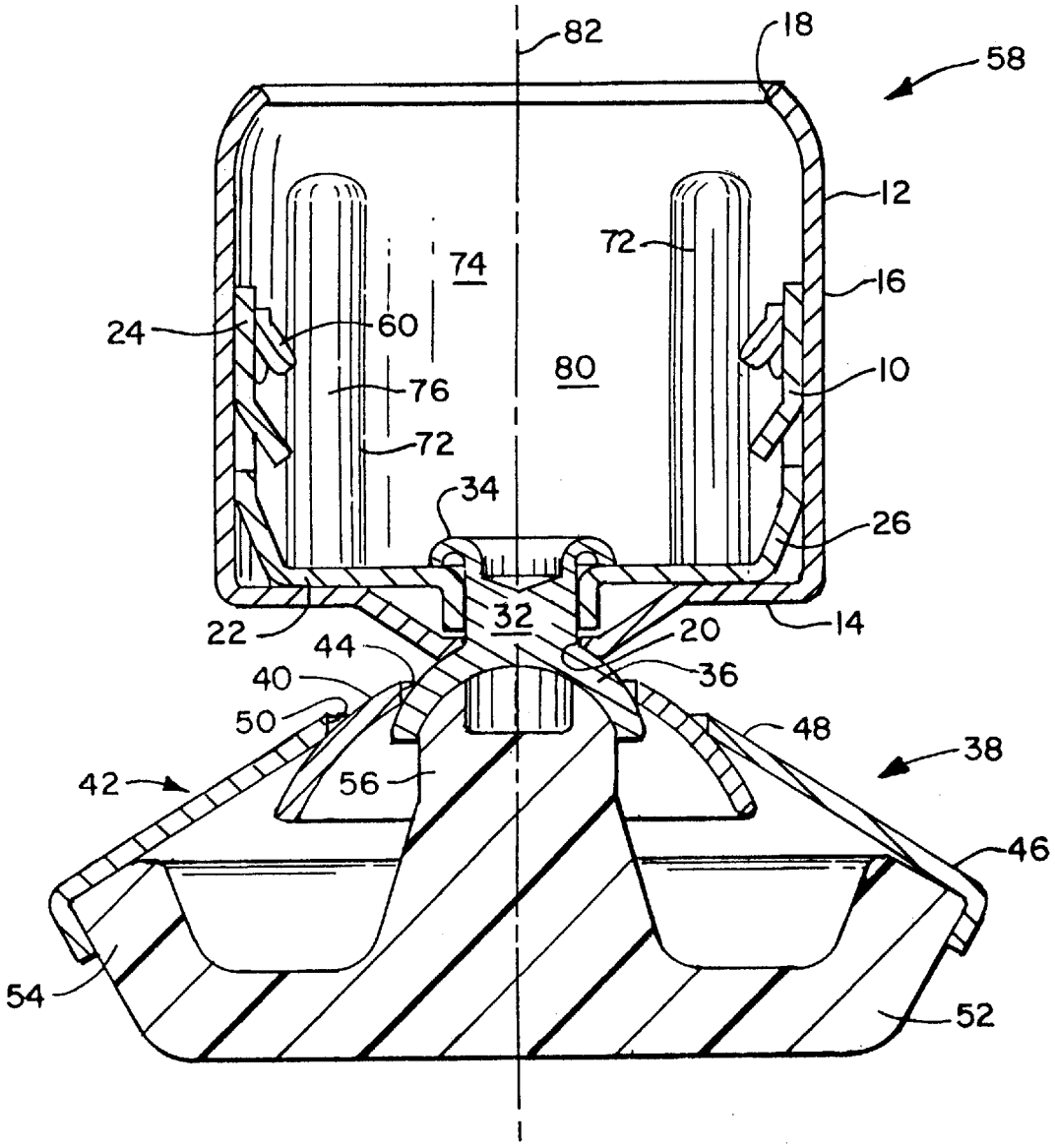
FIG. 1 is a lateral cross-sectional view of the furniture glide having a rivet, an inner shell, an outer shell, a glide base, a ferrule in accordance with the invention and a clip in accordance with the invention.

In the following description of the preferred embodiments of the invention, like numeral identifiers represent like components as depicted in the figures. A clip and ferrule in accordance with a first embodiment of the invention are generally designated by the numerals 10 and 12, respectively. With reference to FIG. 1, the ferrule 12 has a circular bottom wall 14 and an upstanding cylindrical side wall 16. The upper portion of the side wall preferably angles radially inward to define a circular ferrule opening 18. The ferrule opening 18 is preferably chosen to closely match the outer diameter of the furniture leg (not shown). The bottom wall 14 defines a circular rivet opening 20 coaxial with the ferrule opening 18. The bottom wall 14 of the ferrule 12 is further preferably contoured having a dropped portion adjacent the rivet opening 20.

A clip 10 is positioned within the ferrule 12. The clip 10 is formed from a longitudinal resilient metal strip. (See FIGS. 1, 4 and 5) The clip 10 has a clip base 22 which has a footprint smaller than the ferrule opening 18, and a single pair of oppositely positioned clip arms 24, 26. The clip arms 24, 26 extend generally perpendicularly upward from the clip base 22. The unstressed clip arms 24, 26 define a neutral diameter greater than the diameter 28 of the ferrule opening 18. The arms 24, 26 and base 22 of the clip 10 are resiliently deformable whereby as the clip 10 is inserted base first into the ferrule opening 18, the clip arms 24, 26 deform inwardly to the smaller diameter 28 of the ferrule opening 18. The clip arms 24, 26 return to generally the neutral shape after passage through the ferrule opening 18.

The clip base 22 defines a central clip rivet opening 30. The clip rivet opening 30 is aligned with the ferrule rivet opening 20 when the clip 10 is mounted in the ferrule 12. The clip base 22 further projects downward to form a cylindrical portion having a length equivalent to the depth of the contour of the drop portion of the ferrule 12. The rivet openings 20, 30 are of the same diameter.

Figure 2:
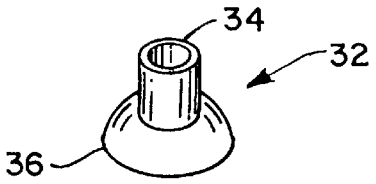
FIG. 2 is a perspective view of the rivet of FIG. 1.

A rivet 32 is secured through the clip and ferrule rivet openings 30, 20. The rivet 32 has an expandable head portion 34 and an opposite swivel portion 36. (See FIGS. 1 and 2) The head portion 34 of the rivet 32 is inserted through the aligned rivet openings 20, 30 and rounded or peened over to pull the swivel portion 36 against the bottom wall 14 of the ferrule 12. The rivet 32 securely fastens the ferrule 12 and clip 10 together. The clip 10 and ferrule 12, when riveted together, are capable of fully supporting a furniture leg, and therefore preferably do not require any additional structural elements. The swivel portion 36 of the rivet 32 extends downward from the bottom wall 14 and radially outward to define a convex spherical outer swivel surface and a concentric inner spherical swivel surface.

A shell assembly 38, having an inner shell 40 and an outer shell 42, slidably engages the outer swivel surface of the rivet 32. The inner shell 40 is generally spherical and defines a circular inner shell opening 44 having a diameter less than the swivel portion 36 of the rivet 32. The inner shell 40 is nested within the outer shell 42. The outer shell 42 has a generally frustoconical shape forming an expanded portion 46 defining an outer edge and a reduced portion 48. The outer shell 42 defines a circular outer shell opening 50 at the reduced portion 48 having a diameter less than the outer diameter of the inner shell 40. The spherical shape of the inner shell 40 allows for improved swiveling sliding engagement of the inner shell 40 with the outer shell 42.

Figure 3:
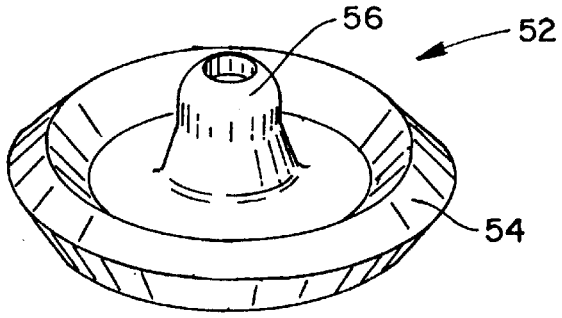
FIG. 3 is a perspective view of the glide base of FIG. 1.

A glide base 52 is mounted to the expanded portion 46 of the outer shell 42. The glide base 52 is preferably molded as a unitary or singular component. The base 52 is circular, having an annular rim portion 54 for engagement to the outer shell 42 and an axial elevated central post portion 56. (See FIGS. 1 and 3) The glide base 52 is mounted in position by the crimped outer edge of the outer shell 42. The post portion 56 of the glide base 52 defines a generally convex base swivel surface in congruent surface-to-surface contact with the inner swivel surface of the rivet 32. The post portion 56 is dimensioned of a sufficient height to maintain the shell assembly 38 in tight engagement with the swivel portion 36 of the rivet 32. The swivel portion 36, inner shell 40, outer shell 42 and glide base 52 are preferably dimensioned to allow swiveling motion of the ferrule 12 relative to the base 52 of up to 32° from the vertical. Only the outer shell 42 would be required for furniture glides 58 that require a smaller degree of swiveling. The glide base 52 is preferably constructed of a hard wear-resistant plastic such as nylon. The glide base 52 acts as a cushion and can slide or glide along a floor surface.

The furniture industry has adopted a standard that requires furniture glides 58 to withstand a pulling force of 200 pounds before they will separate from the furniture leg. U.S. patent application Ser. No. 08/900,476, (hereinafter the '476 application) assigned to the assignee of the subject application, discloses a furniture glide that is similar to the subject furniture glide 58 in many respects. Experimentation has shown that the device of the '476 application will sometimes separate from the furniture leg when a pulling force of 200 pounds is applied.

Both the subject furniture glide 58 and the device of the '476 application utilize a clip 10 having a single pair of opposed clip arms 24, 26. When a furniture leg is inserted into the ferrule 12, the furniture leg is forced between the arms 24, 26 of the clip 10 and the arms 24, 26 are forced radially outward to contact the side wall 16 of the ferrule 12. A single prong on each clip arm of the device of the '476 application and a set of prongs 60 on each clip arm 24, 26 of the subject invention are sufficiently resiliently deformable to be forced radially outwardly by the furniture leg and continue to maintain a radially inward force. The radial inward force of the prongs 60 provides a continuous frictional engagement of the prongs 60 to the outer surface of the furniture leg. The engagement of the prongs 60 to the outer surface thereby secures the furniture glide on the furniture leg.

As noted above, the device of the '476 application has only a single prong on each clip arm. Consequently, the engagement surface of a prong may not be fully utilized to engage the furniture leg if the prong does not have an arcuate shape that is sufficiently matched to the arcuate shape of the surface of the furniture leg. For example, if the prong is too "flat", only the middle portion of the prong will engage the furniture leg. Conversely, if the prong is too "arcuate" only the edge portions of the prong will engage the furniture leg. The prong performs in this manner due to the fact that contact between any portion of the prong and the furniture leg causes the entire prong to be deflected radially outward. Such radial deflection causes the other portions of the prong to move away from the furniture leg.

Figure 4:
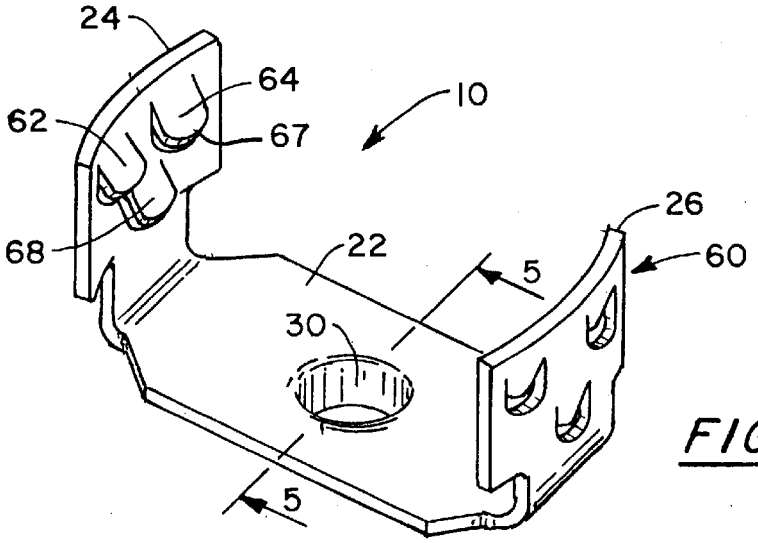
FIG. 4 is a perspective view of the clip of FIG. 1.
Figure 5:
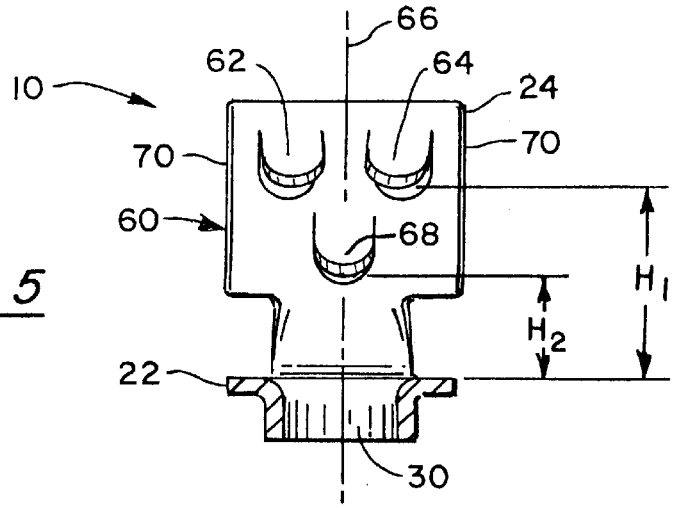
FIG. 5 is a cross-sectional view of the clip taken along line 5—5 of FIG. 4.

With further reference to FIGS. 4 and 5, each clip arm 24, 26 of the subject invention includes a set of three separate radially inward extending prongs 60. Each set of prongs 60 includes two prongs 62, 64 which are disposed are substantially the same distance H1 from the base 22 of the clip 10. Prong 62 is positioned on one side of the clip centerline 66 and prong 64 is positioned on the other side of the clip centerline 66 at substantially the same distance as prong 62. A third prong 68 is positioned on the clip centerline 66 and at a distance H2 from the base of the clip such that it is vertically offset from prongs 62 and 64. As shown in FIGS. 4 and 5, prong 68 may be positioned below prongs 62 and 64. Alternatively, prong 68 may be positioned above prongs 62 and 64. The engagement surfaces 67 of the prongs 62, 64, 68 define a circle having a diameter 69 that is less than the diameter 28 of the ferrule opening 18. When the furniture leg contacts any one of the prongs 62, 64, 68, the contacted prong (62 for example) is resiliently deformed radially outward. However, this deformation is not transmitted to the other two prongs (64, 68) in the set 60 such that the other prongs (64, 68) would be moved away from contact with the furniture leg. In addition, the spring force exerted on the furniture leg by the contacted prong (62) tends to urge the furniture leg laterally into contact with the other prongs (64, 68). Therefore, the subject design ensures that there is greater engagement between the prongs 62, 64, 68 and the furniture leg.

As described above, the side wall 16 of the ferrule 12 has a diameter which is greater than the diameter 28 of the ferrule opening 18, which is chosen to closely match the outer diameter of the furniture leg. Therefore, a space exists between the outside surface of the furniture leg and the side wall 16 of the ferrule 12. Although the arms 24, 26 of the clip 10 are disposed in this space, the gap between the side edges 70 of the two arms 24, 26 leaves the majority of the gap empty. A furniture leg may be cocked when it is inserted into the ferrule such that the furniture leg enters one of the gaps between the clip arm side edges 70. This can have two deleterious effects. First, the portion of the prong that engages the furniture leg may be further reduced when the furniture leg and furniture glide are cocked relative to each other. Second, it has been found that the furniture leg may contact the prong in a manner that results in inelastic deformation of the prong, thereby reducing the biasing force which holds the furniture glide on the furniture leg.

Figure 6:
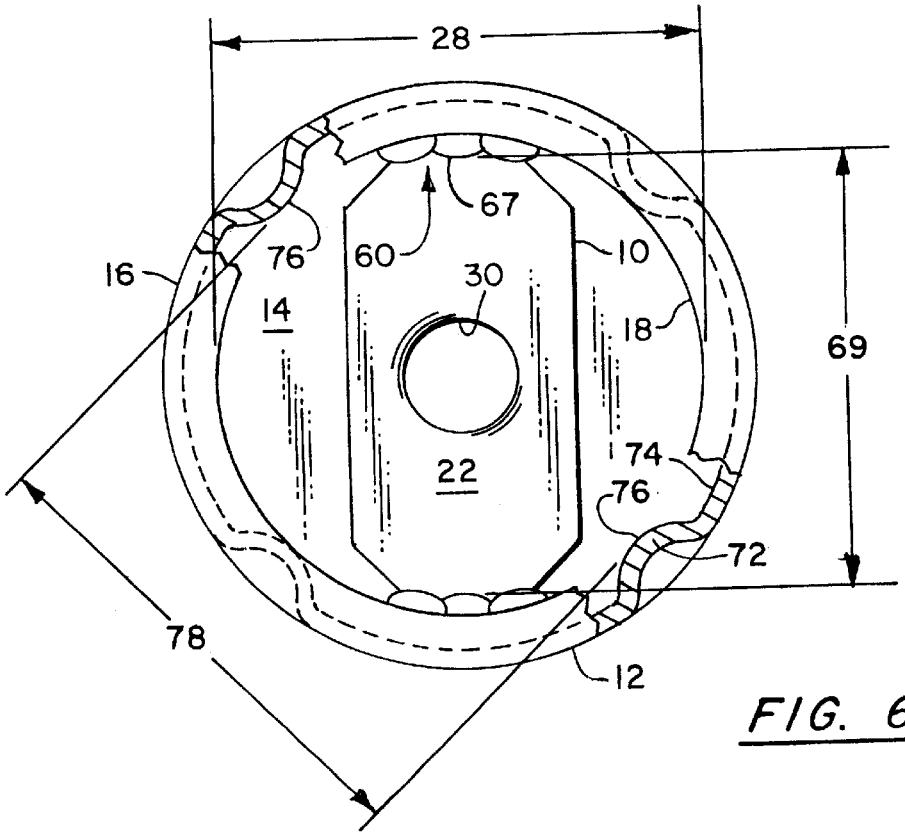
FIG. 6 is a top view of the clip of FIG. 1 installed in the ferrule of FIG. 1.
Figure 7:
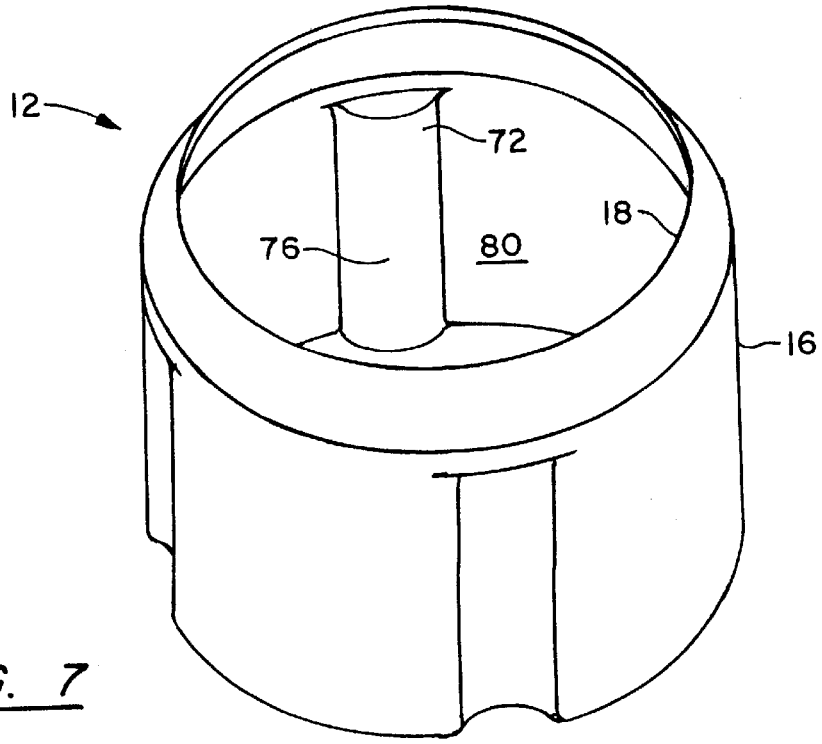
FIG. 7 is a perspective view of the ferrule of FIG. 1.

With reference to FIGS. 1, 6 and 7, the side wall 16 of the ferrule 12 of the subject furniture glide 58 has four ribs 72 extending longitudinally from the bottom wall 14 to a point adjacent the ferrule opening 18. Each rib 72 extends laterally from the inner surface 76 of the ferrule side wall 16 to a distal guide surface 76. The ribs 72 are substantially equidistantly spaced from each other such that the guide surfaces 76 of the ribs 72 define a circle having a diameter 78 which is substantially equal to the diameter 28 of the ferrule opening 18. The clip arms 24, 26 are positioned in opposing channels 80 formed between the ribs 72. The furniture leg slidingly engages the guide surfaces 76 of the ribs 72 as it is inserted through the ferrule opening 18, ensuring that the furniture leg cannot be cocked relative to the axis 82 of the furniture glide 58. It should be appreciated that as few as three ribs may be used to properly guide the furniture leg during installation. In addition, more than four ribs may be used.

Figure 8:
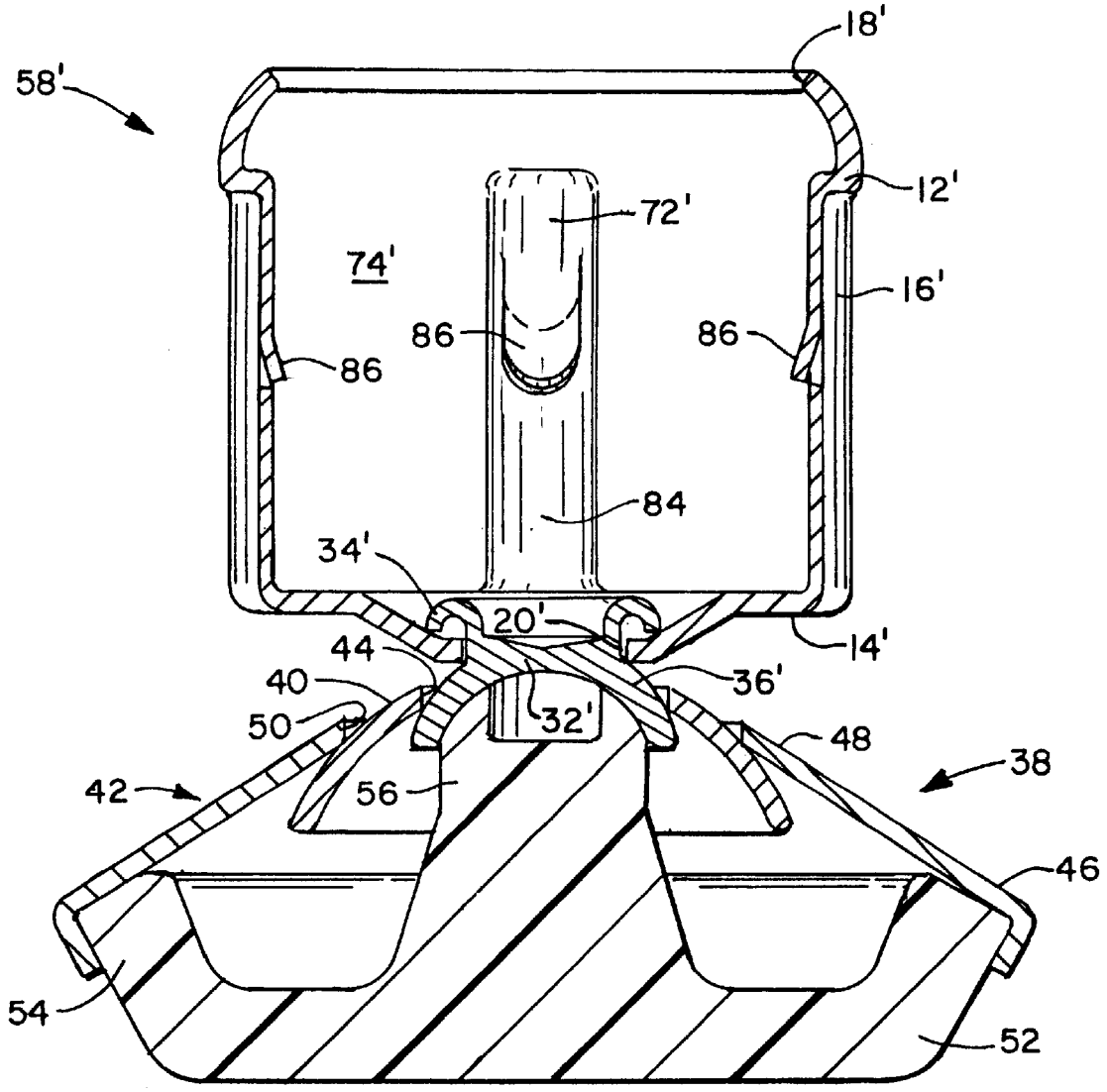
FIG. 8 is a lateral cross-sectional view of an alternate embodiment of the furniture glide of FIG. 1.
Figure 9:
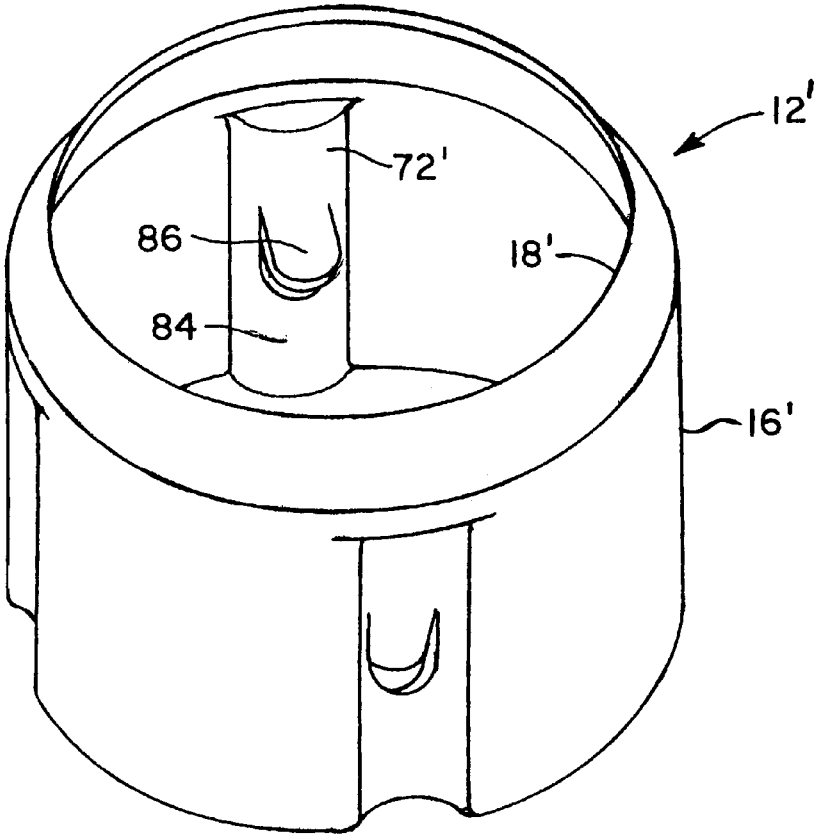
FIG. 9 is a perspective view of the ferrule of FIG. 8.

In a second embodiment of the invention (FIGS. 8 and 9), the furniture glide 58' includes a ferrule 12' having four ribs 72' extending longitudinally from the bottom wall 14' to a point adjacent the ferrule opening 18'. Each rib 72' extends laterally from the inner surface 76' of the ferrule side wall 16' to a distal engagement surface 84. The ribs 72' are substantially equidistantly spaced from each other such that the engagement surfaces 84 of the ribs 72' define a circle having a diameter which is substantially equal to the diameter of the ferrule opening 18'. Each of the ribs 72' has at least one prong 86 extending inwardly from the engagement surface 84. The prongs 86 define a diameter which is smaller than the ferrule opening 18'. The prongs 86 are sufficiently resiliently deformable to be forced radially outwardly by the furniture leg and continue to maintain a radially inward force. The radial inward force of the prongs 86 provides a continuous frictional engagement of the prongs 86 to the outer surface of the furniture leg. The engagement of the prongs 86 to the outer surface thereby secures the furniture glide 58' on the furniture leg. It should be appreciated that as few as three ribs and more than four ribs may be used to secure the furniture glide 58' on the furniture leg.

While a preferred embodiment of the present invention and method for manufacture of the same has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A furniture glide comprising:

a ferrule including a bottom wall, an upstanding cylindrical side wall having a radially inward curving top portion defining a circular ferrule opening having a ferrule opening diameter, and at least three substantially equidistantly spaced, upstanding ribs extending laterally inward from the side wall, said ribs defining an inside diameter substantially equal to the ferrule opening diameter;

at least two equidistantly spaced prong means disposed within said ferrule adjacent said side wall for engaging a furniture leg, each of said prong means comprising at least one radially inward extending prong; and a glide base mounted to said ferrule.

2. The furniture glide of claim 1 further comprising a clip positioned in said ferrule having a clip base in contact with said bottom wall and a plurality of upstanding clip arms defining a clip diameter greater than said ferrule opening diameter, each clip arm having at least one radially inward extending prong defining a said prong means, said clip being resiliently deformable to be insertable through said ferrule opening.

3. The furniture glide of claim 2 wherein said clip has a single pair of oppositely positioned clip arms.

4. The furniture glide of claim 3 wherein said ribs define a plurality of channels disposed intermediate said ribs, said clip arms being disposed in said channels.

5. The furniture glide of claim 1 wherein each of said ribs extends upwardly from said bottom wall to a point adjacent said ferrule opening.

6. The furniture glide of claim 1 wherein each of said ribs includes a guide surface adapted for guiding a furniture leg, each of said ribs extending laterally inward from the side wall to said guide surface.

7. The furniture glide of claim 6 wherein guide surfaces of said ribs are slidingly engageable with the furniture leg for guiding movement of the furniture leg within said ferrule.

8. The furniture glide of claim 1 wherein each rib has at least one radially inward extending prong defining a said prong means.

9. A furniture glide for engaging a furniture leg, comprising:

a ferrule including a bottom wall, an upstanding cylindrical side wall having a radially inward curving top portion defining a circular ferrule opening having a ferrule opening diameter, and a plurality of substantially equidistantly spaced, upstanding ribs extending laterally inward from the side wall, said ribs defining an inside diameter substantially equal to the ferrule opening diameter and a plurality of channels disposed intermediate said ribs;

clip means positioned in said ferrule comprising first and second clip arms disposed within said channels of said ferrule, each clip arm having a plurality of laterally inward extending prongs, the prongs of the first arm being spaced in opposition to the prongs of the second arm at a distance less than the ferrule opening diameter; and a glide base mounted to said ferrule for contacting a floor.

10. The furniture glide of claim 9 wherein said clip means defines a centerline and each of said clip arms has first and second prongs equidistantly spaced from said centerline.

11. The furniture glide of claim 10 wherein each of said clip arms further has a third prong disposed on said centerline.

12. The furniture glide of claim 11 wherein said third prong is longitudinally spaced from said first and second prongs.

13. The furniture glide of claim 10 wherein said clip means further comprises a base, said first and second clip arms extend upwardly from said base, and said first and second prongs are both positioned at a height H1 above said base.

14. The furniture glide of claim 13 wherein each of said clip arms further has a third prong positioned at a height H2 above said base where H2>H1.

15. The furniture glide of claim 14 wherein said third prong is disposed on said centerline.

16. The furniture glide of claim 9 wherein said ribs define two pairs of oppositely disposed channels, said clip arms being disposed in one of said pairs of channels.

17. The furniture glide of claim 9 wherein each of said ribs includes a guide surface adapted for guiding a furniture leg, each of said ribs extending upwardly from said bottom wall to a point adjacent said ferrule opening and radially inward from said side wall to said guide surface.

18. A furniture glide comprising:

a ferrule including an upstanding cylindrical side wall and at least three substantially equidistantly spaced, upstanding ribs extending laterally inward from the side wall, said side wall defining a circular ferrule opening having a ferrule opening diameter, said ribs defining an inside diameter substantially equal to the ferrule opening diameter, each of the ribs having at least one radially inward extending prong, the prongs defining an inside diameter which is less than the ferrule opening diameter; and a glide base mounted to said ferrule for contacting a floor.

19. The furniture glide of claim 18 wherein said ferrule further includes a bottom wall and each of said ribs includes an engagement surface adapted for guidingly engaging a furniture leg, each of said ribs extending upwardly from said bottom wall to a point adjacent said ferrule opening and radially inward from said side wall to said engagement surface.

* * * * *